US010413069B1

(12) United States Patent
Colon

(10) Patent No.: US 10,413,069 B1
(45) Date of Patent: Sep. 17, 2019

(54) BARBER CHAIR TRAY HAVING ADJUSTABLE CONNECTING ASSEMBLIES

(71) Applicant: Speed Barber, LLC, Cooper City, FL (US)

(72) Inventor: Edwin Colon, Cooper City, FL (US)

( * ) Notice: Subject to any disclaimer, the term of this patent is extended or adjusted under 35 U.S.C. 154(b) by 0 days.

(21) Appl. No.: 16/198,010

(22) Filed: Nov. 21, 2018

(51) Int. Cl.
*A47C 1/11* (2006.01)
*A47C 7/62* (2006.01)

(52) U.S. Cl.
CPC ..... *A47C 1/11* (2013.01); *A47C 7/622* (2018.08)

(58) Field of Classification Search
CPC .. A47C 1/11; A47C 7/622; A47C 7/62; B60R 2011/0012; B60R 2011/0017; A45D 44/02
USPC ..... 224/275
See application file for complete search history.

(56) References Cited

U.S. PATENT DOCUMENTS 1,763,488 A 6/1930 Titcomb
2,462,475 A 2/1949 Di Filipo
2,711,213 A * 6/1955 Owens ..... B60N 3/103 248/231.81
3,175,743 A * 3/1965 Richard ..... A47D 7/04 224/275
3,386,392 A * 6/1968 Gramm ..... A47B 5/006 108/134
3,986,649 A * 10/1976 Heimstra ..... B60R 7/043 224/567
4,730,760 A * 3/1988 Keller ..... B60N 3/007 108/18
5,337,984 A * 8/1994 Houck ..... B60N 3/103 224/275
5,370,060 A * 12/1994 Wang ..... B60N 3/004 108/149
5,411,192 A * 5/1995 Xiao ..... A45F 4/02 108/42
5,839,586 A 11/1998 Smith
5,887,940 A 3/1999 Anderson et al.
6,290,063 B1 * 9/2001 Vogt ..... B60N 3/103 206/549
6,601,813 B1 8/2003 Kager et al.
6,722,540 B2 * 4/2004 Ling ..... B60N 3/106 224/275
8,439,190 B2 5/2013 Michel
9,577,571 B2 * 2/2017 Atia ..... H02S 20/23
9,801,469 B2 * 10/2017 Hodge ..... A45D 44/04
2011/0248531 A1 * 10/2011 Powell ..... A47C 1/11 297/163
2012/0125957 A1 5/2012 Barber

* cited by examiner

*Primary Examiner* — Ko H Chan
(74) *Attorney, Agent, or Firm* — The Concept Law Group, PA; Scott D. Smiley; Scott M. Garrett

(57) ABSTRACT

A barber chair tray includes a tray body and adjustable connecting assemblies to connect the tray body to a barber chair. The connecting assemblies connect to a head rest assembly support structure present at the top of the chair's seatback, and allow the tray to hang at the back of the chair. The connecting assemblies allow the tray to swing away from the back of the chair when the chair's seatback is reclined to keep the tray body level, thereby preventing implements on the tray from falling off the tray. The connecting assemblies allow height and width adjustment to facilitate mounting of the chair tray to a variety of chair designs, and to allow the particular user of the tray to select a desired height at which the tray hangs while in use.

13 Claims, 10 Drawing Sheets

BARBER CHAIR TRAY HAVING ADJUSTABLE CONNECTING ASSEMBLIES

FIELD OF THE INVENTION

The present invention relates generally to barber and hair styling tools, and, more particularly, relates to a tray device that couples to a barber chair to hang behind the chair, allowing the barber or stylist to place other tools and implements in the tray, and the tray hangs such that it is always level.

BACKGROUND OF THE INVENTION

Barbers, as well as some beauticians and hair stylists, use special type of chair for their patrons to sit in while their hair is being serviced. The chair will have a reclining back portion and a headrest, which allows the patron's upper body to be leaned back for shaving, washing, and other services. With the chair's back portion in an upright position, the barber can cut and style the patron's hair. During the course of shaving, cutting, washing, styling, etc. the barber will typically use a variety of implements including combs, brushes, razors, clippers, scissors, clips, wraps, and so on. These implements are generally kept on a counter adjacent the chair. However, the barber spends a substantial amount of time standing behind the chair while the chair is oriented toward the counter because there is typically a large mirror behind the counter to allow the patron to watch, and so the barber and patron can see each other for conversation. As a result, every time the barber needs to use a different tool or implement, the barber needs to walk to the counter, and then back behind the patron. It is therefore desirable to have a rack or other implement holder placed closer to where the barber typically stands while working on the patron.

One solution to this problem is given in U.S. Pat. No. 9,801,469, which shows an accessory holder for a barber chair. The disclosed device includes an extension from a main tray portion that is captured by the seat's headrest. That is, the support members of the headrest that extend into the seat back pass through portions of the accessory holder extension, thereby holding the accessory holder with the seat. While this can aid the barber in holding some accessories, it tilts with the chair. Therefore, if the seatback is reclined, such as for shaving the patron or washing hair, accessories in the accessory holder can fall out as the accessory holder is tilted at an angle corresponding to the tilt of the seat back.

Therefore, a need exists to overcome the problems with the prior art as discussed above.

SUMMARY OF THE INVENTION

The invention provides a barber chair tray that overcomes the hereinafore-mentioned disadvantages of the heretofore-known devices and methods of this general type and that couples to the barber chair seat back in a way that allows the barber chair tray to stay level, preventing items in the barber char tray from falling out of the barber char tray when the barber chair seat back is reclined.

With the foregoing and other objects in view, there is provided, in accordance with some embodiments, a barber chair tray that includes a tray body that has a top in which a plurality of tray features are formed. The tray body also includes a skirt portion that extends downward from the top around a periphery of the top. The skirt can be present completely around the tray body, or only partially around the tray body. There can be at least one horizontal slot formed in a chair-facing side of the skirt with at least one captured nut that is captured in alignment with, and behind, the horizontal slot. The captured nut can be moveable along the horizontal slot to allow for width adjustment/selection of the connecting assemblies. The connecting assemblies can include a pair of vertical arms, with each one of the pair of vertical arms having lower portion and a top portion, a vertical slot formed in the lower portion, and a hinge tab extending from the top portion that has a horizontal hinge pin channel. The connecting assemblies can further include a pair of connecting arms, with each one of the pair of connecting arms including a hinge end configured to mate with the hinge tab of the vertical arms and to be hingeably connected to the hinge tab by a hinge pin. The connecting arms can further include a mounting end having an adjustment slot. The vertical slot in each vertical arm can be configured to receive a vertical adjustment screw member therethrough that couples with a fixed nut or a captured nut to hold the vertical arm at a selected height relative to the fixed nut or the captured nut. The adjustment slot in each connecting arm is configured to receive a mounting screw therethrough, and the mounting screw is configured to mount a headrest plate onto the top of a barber chair to support a headrest.

In accordance with a further feature, at the top portion of each of the pair of vertical arms, there can be one or more angle-limiting extensions configured to limit rotation of one or both of the connecting arms that are hingeably connected to the vertical arm to a selected angle, meaning the angle cannot be smaller than the selected angle, and in accordance with a further feature, the selected angle can be about ninety degrees.

In accordance with a further feature, there are two horizontal slots, each slot having a respective captured nut for receiving the respective vertical adjustment screw member.

In accordance with a further feature, the plurality of tray features can include at least one pocket that extends downward from the top of the tray body and which has a bottom.

In accordance with a further feature, the plurality of tray features can include a clipper guard rack.

In accordance with a further feature, the tray feature can include a pocket that extends downward from the top of the tray body and which has a bottom, and a dispensing slot formed through the skirt to the pocket at a location on the skirt opposite the chair-facing side of the skirt. The ray features can also include a tray insert that is sized to cover the pocket, and which has a rim that extends outward from a periphery of a top of the tray insert that is configured to bear against the top of the tray to hold the tray insert over the pocket without allowing it to fall into the pocket.

In accordance with some embodiments, there can be provided a barber chair tray that includes a tray body having a top in which a plurality of tray features are formed, and a skirt portion that extends downward from the top around a periphery of the top. The barber chair tray can further include a pair of horizontal slots formed in a chair-facing side of the skirt, and a pair of threaded connectors disposed with and captured behind a respective one of the pair of horizontal slots such that each threaded connector can slide horizontally and is prevented from moving vertically. The barber chair tray can further include a pair of vertical arms. Each one of the pair of vertical arms can have a lower portion and a top portion, with a vertical slot formed in the lower portion and a hinge tab extending from the top portion, where the hinge tab includes a horizontal hinge pin channel. The barber chair tray can further include a pair of connecting arms. Each one of the pair of connecting arms can include a hinge end configured to mate with the hinge tab of the vertical arms and to be hingeably connected to the hinge tab by a hinge pin. Each of the connecting arms can also include a mounting end having an adjustment slot. The vertical slot in each vertical arm can be configured to receive a vertical adjustment screw member therethrough that couples with a corresponding one of the pair or threaded connectors to hold the vertical arm at a selected height relative to a fixed nut or at least one captured nut. The adjustment slot in each connecting arm is configured to receive a mounting screw therethrough, wherein the mounting screw is configured to mount a headrest plate onto the top of a barber chair.

In accordance with a further feature, at the top portion of each of the pair of vertical arms, there can be at least one angle-limiting extension that is configured to limit rotation of a one of the connecting arms hingeably connected to the vertical arm to a selected angle.

In accordance with a further feature, the selected angle can be ninety degrees.

In accordance with a further feature, the plurality of tray features comprises at least one pocket that extends downward from the top of the tray body and which has a bottom.

In accordance with a further feature, the plurality of tray features comprises a clipper guard rack.

In accordance with a further feature, there can be includes a pocket that extends downward from the top of the tray body and which has a bottom, and a dispensing slot formed through the skirt to the pocket at a location on the skirt opposite the chair-facing side of the skirt. The tray features can also include a tray insert that is sized to cover the pocket, and which has a rim that extends outward from a periphery of a top of the tray insert that is configured to bear against the top of the tray to hold the tray insert over the pocket without allowing it to fall into the pocket.

In accordance with some embodiments, there can be provided a barber chair tray for holding implements at a back of a reclining barber chair having a headrest. The barber chair tray can include a tray body having a top in which a plurality of tray features are formed, and a skirt portion that extends downward from the top around a periphery of the top. The barber chair tray can further include a first hinged connecting assembly and a second hinged connecting assembly that each couple the tray body to a top of a seatback of the reclining barber chair. Each of the first and second hinged connecting assemblies can include a vertical arm that connects the tray body at a chair-facing side of the tray body, a connecting arm that connects to the top of the seatback, and a hinge connecting the vertical arm to the connecting arm.

In accordance with a further feature, at least one of the first or second hinged connecting assemblies comprises an angle-limiting extension at the hinge that is configured to limit rotation of the connecting arm relative to the vertical arm to a selected angle.

In accordance with a further feature, a connecting point of the vertical arm to the tray body for each of the first and second hinged connecting assemblies is vertically adjustable.

In accordance with a further feature, vertical adjustment is accomplished by a vertical slot provided in the vertical arm of each of the first and second hinged connecting assemblies.

In accordance with a further feature, a connecting point of the vertical arm to the tray body for each of the first and second hinged connecting assemblies is horizontally adjustable.

In accordance with a further feature, horizontal adjustment is accomplished by at least one horizontal slot provided the skirt portion of the tray body at the chair-facing side of the tray body.

In accordance with a further feature, the barber chair tray can further include a horizontally sliding connector captured in correspondence with the at least one horizontal slot.

Although the invention is illustrated and described herein as embodied in a barber chair tray, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail", "vertical", "horizontal" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the vertical or connecting arms, generally. Those skilled in the art can understand the specific meanings of the above-mentioned terms in the embodiments of the present invention according to the specific circumstances

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
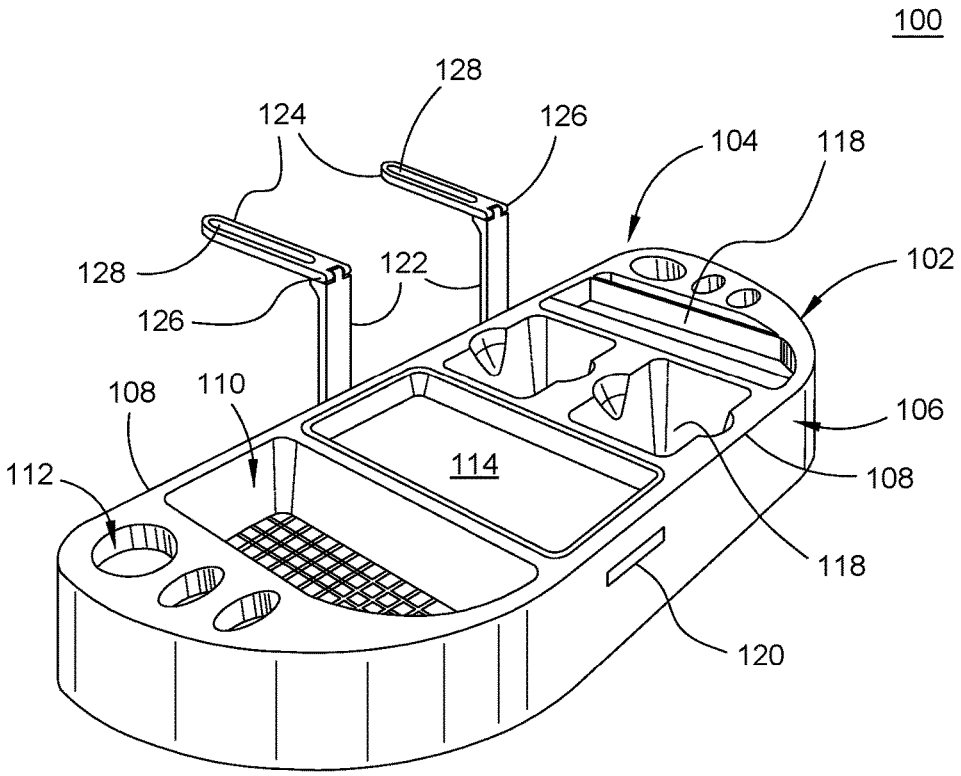
FIG. 1 is perspective view of a barber chair tray, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel barber chair tray that can hold hair styling accessories and other implements in a level state as the barber chair seat back is reclined.

FIG. 1 is perspective view of a barber chair tray 100, in accordance with some embodiments. The barber chair tray 100 includes a tray portion 102 that generally has a top surface 104 and a skirt portion 106 depending from the top surface 104 around a periphery 108 of the top surface 104. The skirt 106 forms a side wall that extends down from the top surface 104. The tray portion can be made, for example, of a polymeric material such as plastic. It can also be made of a forged/stamped metal such as mild steel or stainless steel.

The tray portion 102 includes a plurality of tray features formed in the top surface 104, such as, for example, pockets such as pocket 110, openings of various shapes and sizes such as opening 112, a tray insert 114, pocket 116 having finger recesses, and a clipper guard rack 118. The pockets 110, 116 can be sized to hold specific accessories or implements such as clippers. Some pockets 110 can be sized to hold items in general, without being sized for any particular implement. The tray insert 114 can be a flat tray piece that covers a pocket or other recess in which something can be stored/held. For example, a roll or package of paper neck wraps can be disposed in a pocket under tray insert 114, with the neck wraps being dispensed through a dispensing slot 120 formed in the skirt 106 opposite the chair-facing side of the skirt 106. The tray insert can include a rim that extends outward from a periphery of a top of the tray insert that is configured to bear against the top of the tray to hold the tray insert over the pocket without allowing it to fall into the pocket. The clipper guard rack 118 is designed as several adjacent elongated openings in which clipper guards can be placed, and through which any hair on the clipper guards can fall upon being placed in the clipper guard rack 118.

To connect the tray portion 102 to a barber chair, there is a vertically and horizontally adjustable connecting assembly that connect to a headrest mounting plate of the barber chair, and to a chair-facing side of the skirt 106. By being horizontally and vertically adjustable, the barber chair tray 100 can be mounted on barber chairs having different designs, and the barber can adjust the positions of the barber chair tray 100 to their liking. In the example of FIG. 1, there are first and second connecting assemblies formed by a pair of vertical arms 122 that connect to the chair-facing side of the skirt 106 using, for example, screws or bolts (a screw member). The vertical arms 122 each connect at a hinge 126 to a respective connecting arm 124. The connecting arms 124 have a central slot 128 along a portion of the connecting arm 124. The slot 128 allows a threaded portion of a screw member to pass through the slot and into, for example, a mounting plate on top of a barber chair back, wherein the head of the screw member will bear against the connecting arm 124 outside of the slot 128 to retain the connecting arm, and hence the vertical arms 122 and the tray portion 102 to the barber chair. More detail of these features follows in several of the subsequent drawings.

Figure 2:
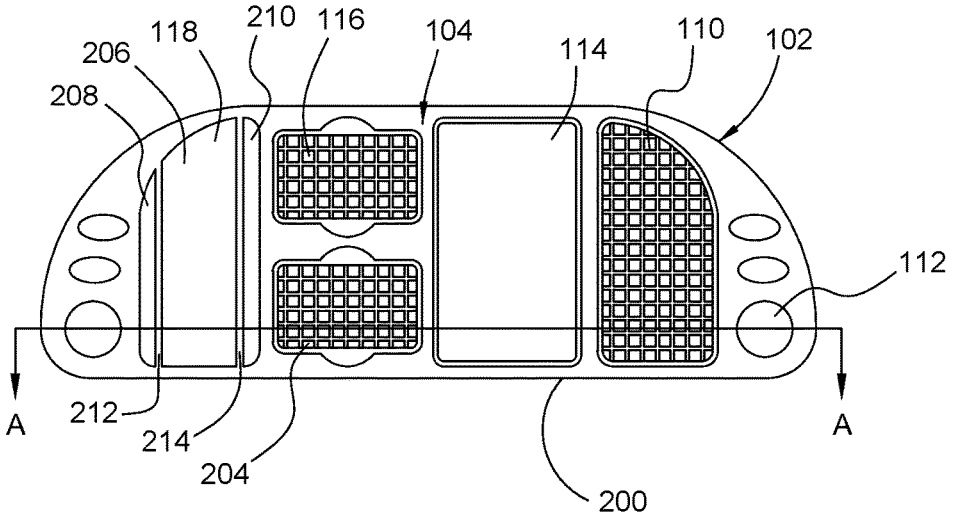
FIG. 2 is a top view of a tray portion of a barber chair tray, in accordance with some embodiment.

FIG. 2 is a top view of a tray portion 102 of the barber chair tray of FIG. 1, in accordance with some embodiments. From the top view as shown the chair-facing side 200 of the skirt is at the bottom of the drawing. The various tray features such as pockets 110, 116, 204 are shown, as well as opening 112 and clipper guard rack 118. In this view the it can be seen that the clipper guard rack 118 includes a relatively wide elongated central opening 206 that is flanked on each side by narrower openings/slots 208, 210, with parallel rails 212, 214 separating the slots 208, 210 from the central opening 206. There can also be a plurality of openings such as opening 112 that are configured to hold implements such as scissors or other styling implements.

Figure 3:
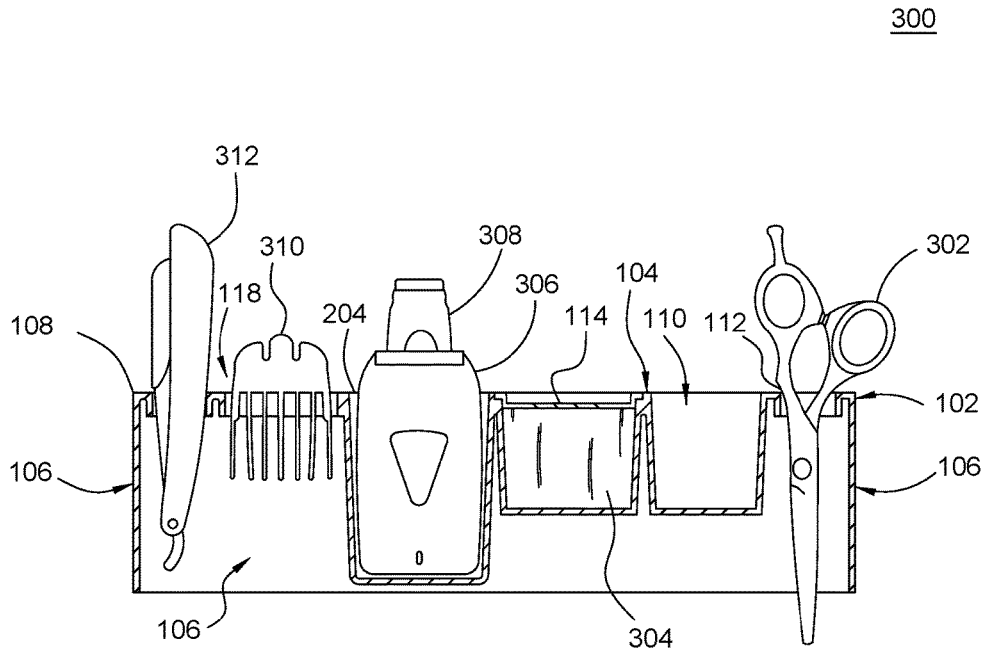
FIG. 3 is a side cut-away view of a barber chair tray looking from the chair-facing side of the barber chair tray, in accordance with some embodiments.

FIG. 3 is a side cut-away view of the tray portion 102 of a barber chair tray 100 looking from the chair-facing side of the barber chair tray 100, in accordance with some embodiments. IN this view it can be seen that the skirt 106 depends from an outer periphery 108 of the top surface 104. Several implements are included in this view as examples of what can be held in the tray 100. For example, a pair of scissors 302 can be held in opening 112. Under tray insert 114 there can be disposed a package of neck wraps 304 that can be individually dispensed through a slot (e.g. 120) on the opposite side of the tray 100. Various clippers 306, 308 can be placed in pockets 116, 204, and clipper guard 310 is shown in clipper guard rack 118. Straight razor 312 is shown placed in an opening similar to opening 112 on an opposite side of the tray 100. Numerous other implements can be placed in the tray portion 102, in pockets or opening, or on top of tray insert 114. Further, the tray features can be varied in location, size, arrangement, inclusion, and so on, as may be preferred for different purposes (e.g. barber, hair stylist).

Figure 4:
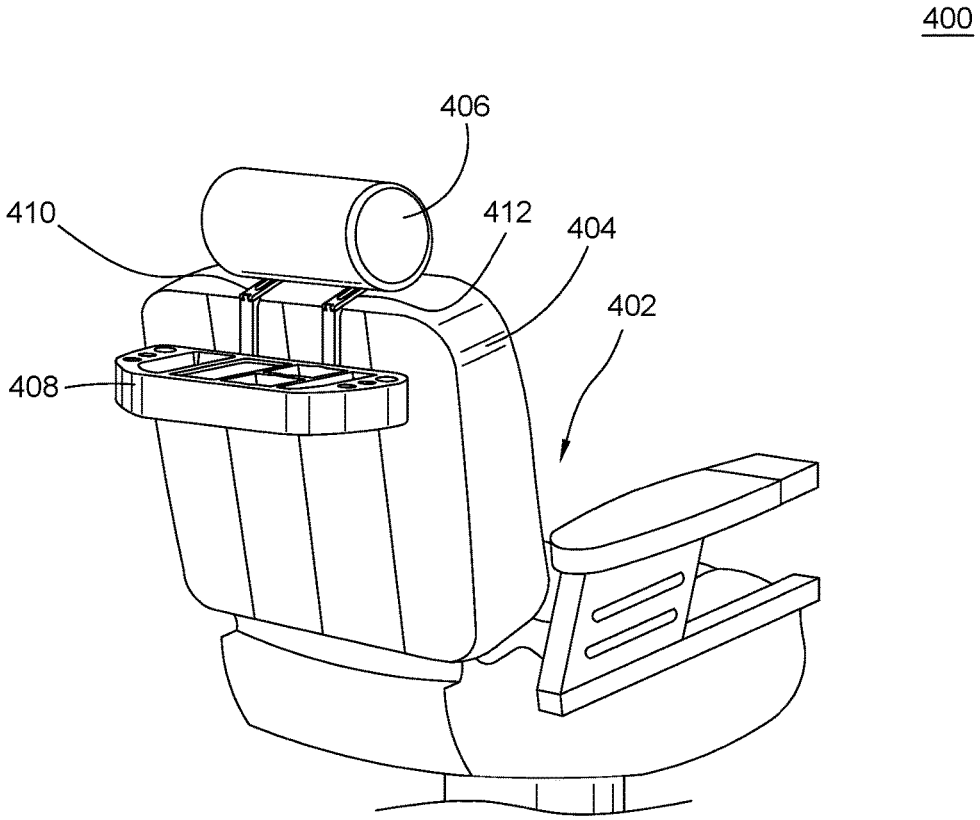
FIG. 4 is a rear perspective view of a barber chair to which a barber chair tray is attached, in accordance with some embodiments.

FIG. 4 is a rear perspective view 400 of a barber chair 402 to which a barber chair tray 408 is attached, in accordance with some embodiments. The barber chair 402 includes a seat back 404 against which a patron can lean against with their back when sitting in the barber chair 402. At the top of the seat back 404 is a head rest 406. The head rest has a support or supports which extend into the seat back 404, allowing the head rest 406 to be raised and lowered, as is known. Typically these supports pass through a plate (not seen here) on the top of the seat back 404. Connecting arms 410, 412 connect to the plate, and allow some lateral adjustment due to the central slot (e.g. 128) formed in the connecting arms. When the seat back 404 is reclined (from the upright position shown here), the hinge elements (e.g. 126) coupling the connecting arms to the vertical arms allow the tray portion 408 to remain level instead of tilting with the seat back 404.

Figure 5:
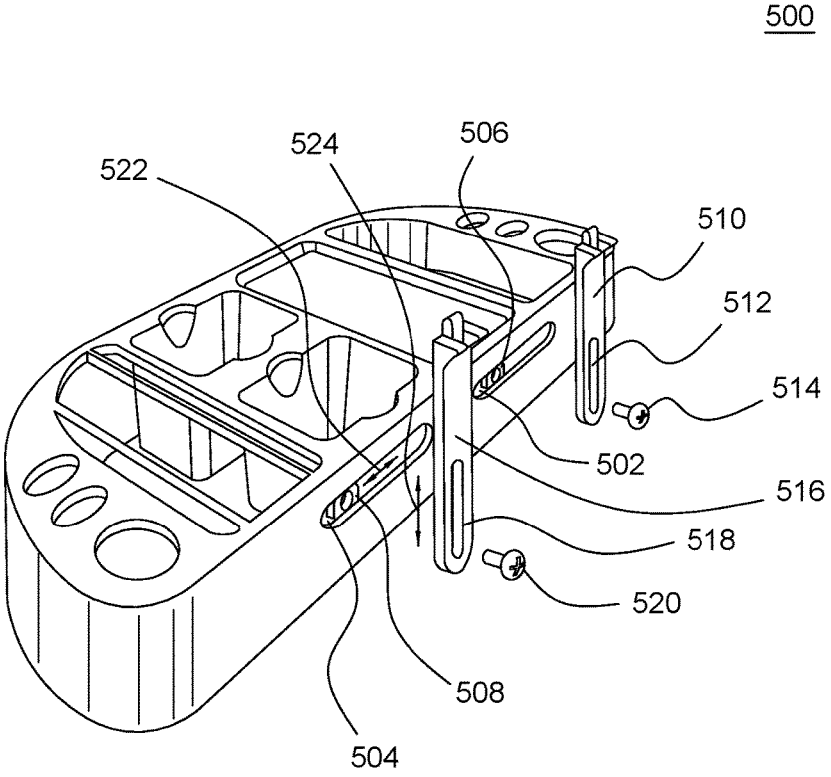
FIG. 5 is a perspective view of a barber chair tray showing how the height of the vertical arms and the width between them can be adjusted to connect the barber chair tray to any barber chair, in accordance with some embodiments.

FIG. 5 is a perspective view of a barber chair tray 500 showing how the height of the vertical arms and the width between them can be adjusted to connect the barber chair tray to any barber chair, in accordance with some embodiments. At least one horizontal slot on the chair-facing side of the tray 500 allows a width adjustment between the vertical arms, while horizontal slots in the vertical arms allow for a vertical adjustment of the height of the tray 500 relative to the barber chair.

In the present example there are shown two horizontal slots 502, 504 in the chair-facing side of the skirt of the tray 500 that allow horizontal adjustment of the connection point of the vertical arm or arms. In correspondence with each slot is a connector that can be captured so as to allow the connector to move horizontally. In some embodiments the captured connector can be limited to moving only horizontally and not vertically. In some embodiments the connector can be a snap fit connector in which a deformable connecting member with a retention feature can be placed while passing through the vertical slot 512, 518 of a vertical arm 510, 516. In some embodiments the connector can be a threaded connected that receives a screw member. In some embodiments the threaded connector can be a hexagonal machine nut. Thus, in some embodiments, behind the horizontal slots 502, 504 there can be another portion of the tray 500 that captures a nut 506, 508 in alignment or in correspondence with the slot. That is, the slots 502, 504 are wide enough to allow access to the threaded hole in the nuts 506, 508, but not wide enough to allow the nuts 506, 508 to pass through the slots 502, 504. The vertical arms 510, 516 each have a lower portion having a vertical slot 512, 518 through which the threaded portion of a screw member 514, 520 can pass to engage the threaded hole of the corresponding nut 506, 508. Thus, the vertical arms 510, 516 can be adjusted horizontally by adjusting the horizontal position of a nut or nuts in their respective slot, as indicated by arrow 522. Further, the vertical arms 510, 516 can be vertically adjusted along the vertical slots 512, 518 as indicated by arrow 524. When the vertical arms 510, 516 have been adjusted to a desirable horizontal and vertical position, the screw members 514, 520 can be tightened to fix the vertical arms 510, 516 relative to the chair-facing side of the skirt of the tray 500. As indicated, in this example both vertical arms are horizontally adjustable, but in some embodiments there can be only one horizontal slot as only one of the vertical arms needs to be horizontally moveable to adjust the width between them. It is contemplated that, in some embodiments, only one of the connectors, such as nuts 506, 508, is movable, and the other can be fixed (e.g. not moveable) as only one needs to be moveable in order to adjust the width between the first and second hinged connecting assemblies.

Figure 6:
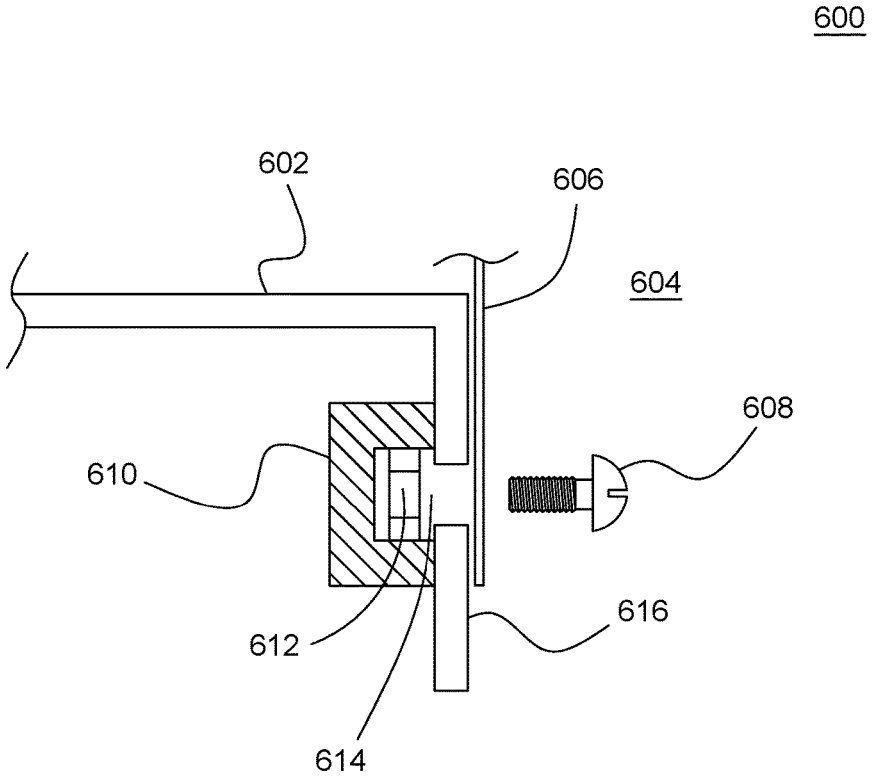
FIG. 6 is a side cut-away view of a captured nut in a barber chair tray for adjusting width and height relating to the vertical arms used to attach the barber chair tray to a barber chair, in accordance with some embodiments.

FIG. 6 is a side cut-away view 600 of a captured nut 612 in a barber chair tray for adjusting width and height relating to the vertical arms used to attach the barber chair tray to a barber chair, in accordance with some embodiments. A tray portion 602 includes a skirt 616 having a chair-facing portion or side 604 in which a horizontal slot 614 is formed. Behind the slot 614 is a housing or track 610, or equivalent member, which forms a channel in which the captured nut 612 is located. The channel has a height that is greater than the height of the horizontal slot 614 and is positioned such that the threaded hole in the center of the nut 612 is completely accessible through the slot 614. The nut 612 can be a conventional hexagonal nut, and the channel can be slightly higher than the width of the nut 612 (from flat side to opposite flat side) to prevent the nut 612 from rotating in the channel but allowing it to move horizontally within the channel. Positioned in front of the chair-facing side 616 is a vertical arm 606 which can be substantially similar to vertical arms 510, 516 of FIG. 5, and has a vertical slot formed in the lower portion of the vertical arm 606 through which the threaded portion of a screw member 608 can pass to engage and thread into the captured nut 612. The screw member 608 can be a screw or bolt or equivalent structure that engages the captured nut or equivalent member tightly enough to hold the vertical arm in a selected position. The vertical arm 606 can be moved vertically with the screw member 608 passing through the vertical slot of the vertical arm, and the horizontally by moving the vertical arm 606, nut 612, and screw member 608 along the horizontal slot 614.

It will be appreciated by those skilled in the art that there are various alternative structures that can allow vertical and horizontal adjustment of the vertical arms to the tray body. For example, a sliding boss member can extend from the tray body that passes through the vertical slot of the respective vertical arm. In general, the connection points of the vertical arms to the tray body are both vertically (height) and horizontally (width) selectable and adjustable.

Figure 7:
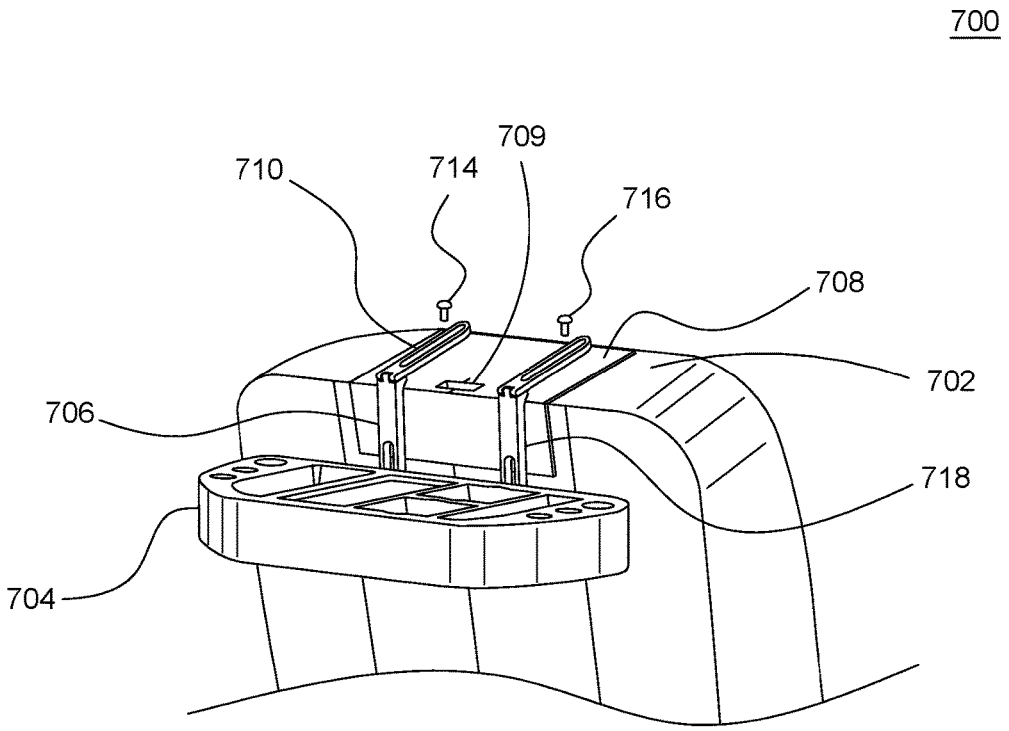
FIG. 7 is a rear perspective view of the top of a barber chair showing how a barber chair tray connected to the barber chair, in accordance with some embodiments.

FIG. 7 is a rear perspective view of the top 702 of a barber chair 700 showing how a barber chair tray 704 is connected to the barber chair 702, in accordance with some embodiments. The top 702 of the barber chair can include a mounting plate or bracket or headrest plate 708 in which a support hole 709 is formed to receive a support member for a head rest (not shown). The plate 708 supports the head rest to keep it centered over the top 702 of the chair 700. The plate 708 can be attached to the top 702 of the chair 700 using screw members 714, 716 (e.g. mounting screws) that have a threaded shank that screw into a rigid frame or similar structure inside the seat back, passing through the slots of the connecting arms 710, 712 at a mounting end of the connecting arms 710, 712.

The tray 704 is coupled to a pair of vertical arms 706, 718 at a chair-facing side of a skirt of the tray 704. The vertical arms 706, 718 extend up, vertically from the tray 704 to hingeably connect with respective connecting arms 710, 712. The connecting arms 710, 712 have an adjustment slot similar to the vertical slot in the vertical arms 706, 718 which allows screw members 714, 716 to pass through the adjustment slot such that the head of the screw members 714, 716 bears against the connecting arm to fix it in a desired position. The adjustment slot in each connecting arm 710, 712 allows the user to adjust the position of the connecting arms relative to the screw members 714, 716 so that the hinge connector formed by the top of the vertical arms 706, 718 and the hinge tabs of the connecting arms extend slightly over a back edge of the plate 708 to allow the vertical arms 706, 718 to extend downward, without bearing against the back side of the chair 700. As the seat back is reclined, the hinged joints allow the tray to remain substantially level.

Figure 8:
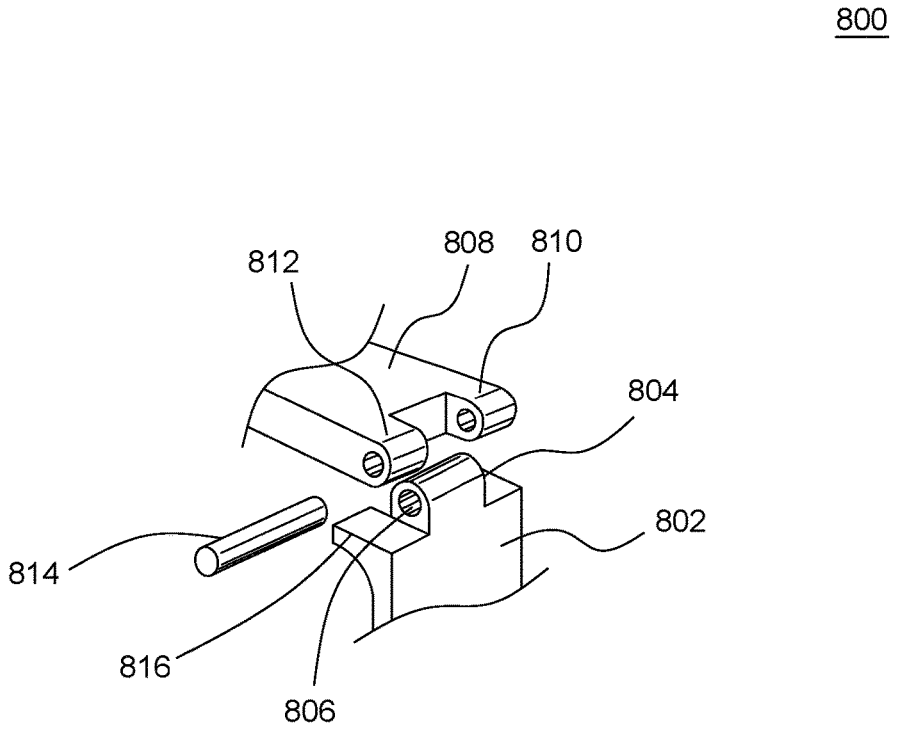
FIG. 8 shows a detail of how a vertical arm and a connecting arm of a barber chair tray couple together, in accordance with some embodiments.

FIG. 8 shows a detail of how a vertical arm 802 and a connecting arm 808 of a barber chair tray couple together, in accordance with some embodiments. Only the top portion of the vertical arm 802, and the hinge end of the connecting arm 808 are shown but the these components can be substantially similar to the vertical and connecting arms shown in FIGS. 1, 5, and 7. The top portion of the vertical arm 802 includes a hinge tab 804 that includes a horizontal hinge pin channel 806 formed through the hinge tab 804. The hinge tab 804 can fit between two similar hinge tabs 819, 812 formed in the hinge end of the connecting arm 808, each of which have a similar hinge pin channel. A hinge pin 814 can pass through the hinge pin channels in hinge tabs 804, 810, 812 to form a hinge, allowing the vertical arm 802 and connecting arm 808 to move relative to each other about the hinge pin 814.

The top of the vertical arm 802 can include an angle-limiting extension such as standoff feature 816 on either side of the hinge tab 804 the prevents the vertical arm from rotating under the connecting arm 808 such that there is less than a selected angle. The standoff features 816 bear against the bottom of the connecting arm when the angle between the vertical arm 802 and the connecting arm 808 is at ninety degrees. As shown here, the standoff features are at ninety degrees to the elongated direction of the vertical arm body, and thus the angle between the vertical arm and the connecting arm, under the connecting arm, cannot be less than ninety degrees. Those skilled in the art will appreciate that different minimum angles can be selected by controlling the angle of the standoff features 816 with respect to the vertical arm.

The vertical arm 802, connecting arm 808, and hinge pin 814 can be made of any suitable material, including metals or polymeric materials. The vertical arm 802, connecting arm 808, and hinge pin 814 can each be made of different materials, or they can all be made of the same material. The hinge pin 814 can be longer than the total length of the hinge pin channels, and after being inserted through the hinge pin channels the opposing ends of the hinge pin be worked to expand the ends so that the ends cannot pass through the hinge pin channels, thereby retaining the hinge pin 814 in the hinge pin channels.

Figure 9:
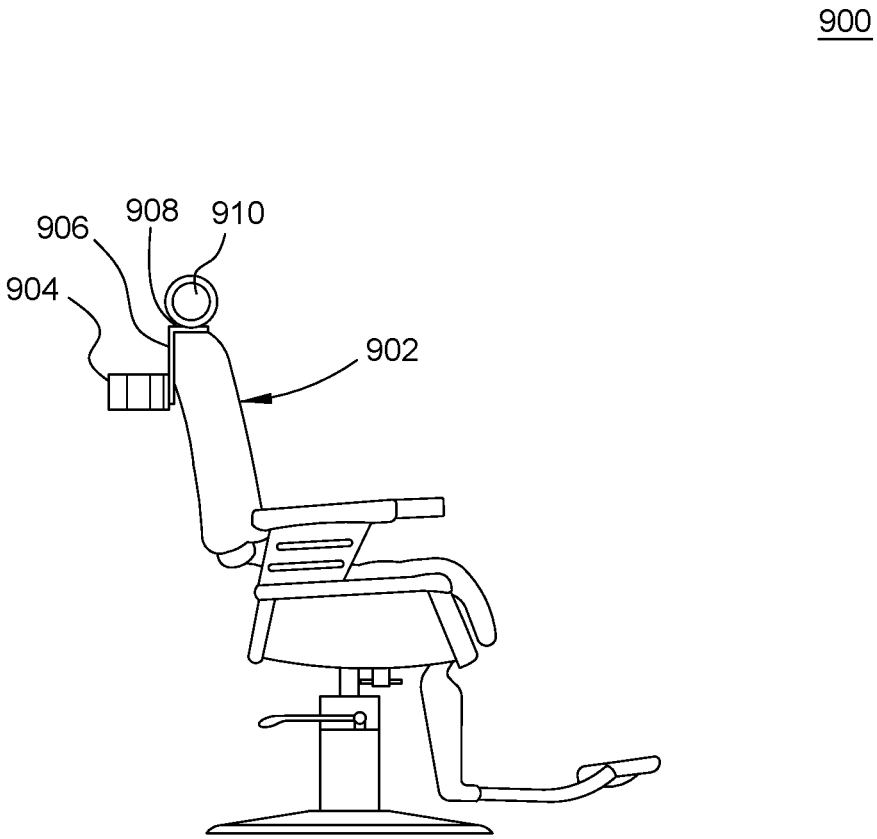
FIG. 9 shows a barber chair with a barber chair tray in an upright position, in accordance with some embodiments.

FIG. 9 shows a reclining barber chair 900, with a barber chair tray 904, and with the chair seat back 902 in an upright position, in accordance with some embodiments. The barber chair tray 904 is connected to the mounting plate that supports the head rest 910 via the vertical arms 906 that are hingeably connected to the connecting arms 908, in accordance with the hinge structure of FIG. 8. The vertical arms 906 are at substantially ninety degrees to the connecting arms 908.

Figure 10:
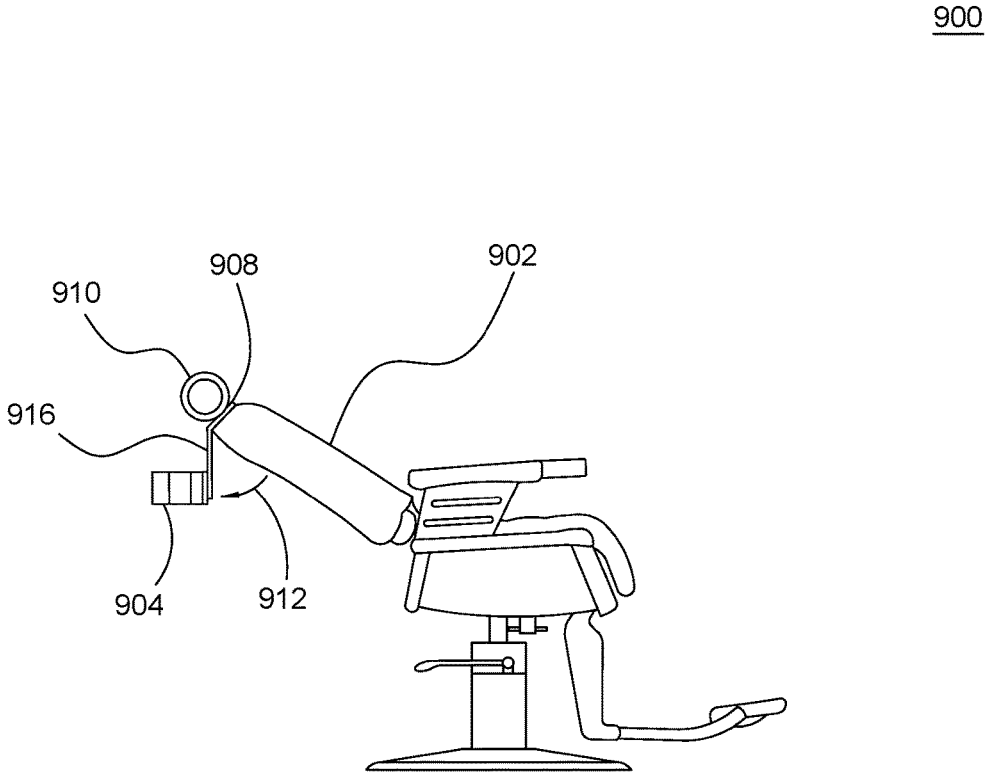
FIG. 10 shows a barber chair with a barber chair tray in a reclined position, in accordance with some embodiments.

FIG. 10 shows a reclining barber chair 900, with a barber chair tray 904, and with the chair seat back 902 in a reclined position, in accordance with some embodiments. With the chair seat back 902 reclined, the barber chair tray 904 remain substantially level as it swings away from the back of the chair seat back 902 as indicated by arrow 912. The hinge joint formed at the coupling of the vertical arms 906 and the connecting arms 908 allow the tray 904 to remain level as the chair seat back 902 is reclined. When the chair seat back 902 is raised back to the upright position, the angle between the vertical arms 906 and the back of the chair seat back 902 will decrease as the tray swings back toward the seat back 902.

Accordingly, embodiments of the inventive disclosure provide a barber chair tray that is configured to connect to top of a reclining chair seatback, and hang below the top of the seatback and the back of the chair. As the chair seatback is reclined, the tray will remain level by swinging away from the back of the seat. This movement is facilitated by a connecting assemblies that allow movement of the tray relative to the seat, such as with, for example, hinges. The connecting assemblies firmly connect the tray to the top of the chair, taking advantage of mounting elements present for supporting a head rest of the chair. The inventive barber chair tray thereby allows the barber or similar service provider to remain behind or beside the chair while providing service to a patron or customer, keeping frequently used implements in easy reach, and providing a level surface in the event the service provider needs to place a container with liquids on the tray, and to keep implements on the tray from sliding off and falling on the floor, as would happen if the tray were rigidly mounted to the chair.

What is claimed is:

1. A barber chair tray, comprising:

a tray body having a top in which a plurality of tray features are formed, and a skirt that extends downward from the top around a periphery of the top;

at least one horizontal slot formed in a chair-facing side of the skirt;

at least one captured nut that is captured in alignment with, and behind, the at least one horizontal slot and moveable along the at least one horizontal slot;

a pair of vertical arms, each one of the pair of vertical arms having lower portion and a top portion, a vertical slot formed in the lower portion and a hinge tab extending from the top portion that has a horizontal hinge pin channel;

a pair of connecting arms, each one of the pair of connecting arms including a hinge end configured to mate with the hinge tab of the vertical arms and to be hingeably connected to the hinge tab by a hinge pin, and a mounting end having an adjustment slot;

wherein the vertical slot in each vertical arm is configured to receive a vertical adjustment screw member therethrough that couples with the at least one captured nut, and upon being coupled to the at least one captured nut the adjustable screw member holds the vertical arm at a selected height relative to the fixed nut or at least one captured nut; and wherein the adjustment slot in each connecting arm is configured to receive a mounting screw therethrough, wherein the mounting screw is configured to mount a headrest plate onto the top of a barber chair.

2. The barber chair tray of claim 1, further comprising:

at the top portion of each of the pair of vertical arms, at least one angle-limiting extension that is configured to limit rotation of a one of the connecting arms hingeably connected to the vertical arm to a selected angle.

3. The barber chair tray of claim 2, wherein the selected angle is ninety degrees.

4. The barber chair tray of claim 1, wherein the at least one horizontal slot formed in the chair-facing side of the skirt comprises two horizontal slots, each slot having a respective captured nut for receiving the respective vertical adjustment screw member.

5. The barber chair tray of claim 1, wherein the plurality of tray features comprises at least one pocket that extends downward from the top of the tray body and which has a bottom.

6. The barber chair tray of claim 1, wherein the plurality of tray features comprises a clipper guard rack.

7. The barber chair tray of claim 1, further comprising:

a pocket that extends downward from the top of the tray body and which has a bottom; and a dispensing slot formed through the skirt to the pocket at a location on the skirt opposite the chair-facing side of the skirt; and a tray insert that is sized to cover the pocket, and which has a rim that extends outward from a periphery of a top of the tray insert that is configured to bear against the top of the tray to hold the tray insert over the pocket without allowing it to fall into the pocket.

8. A barber chair tray, comprising:

a tray body having a top in which a plurality of tray features are formed, and a skirt that extends downward from the top around a periphery of the top;

a pair of horizontal slots formed in a chair-facing side of the skirt, each of the pair of horizontal slots having a nut captured therein;

a pair of threaded connectors, each one of the pair of threaded connectors disposed with and captured behind a respective one of the pair of horizontal slots such that each threaded connector can slide horizontally and is prevented from moving vertically;

a pair of vertical arms, each one of the pair of vertical arms having lower portion and a top portion, a vertical slot formed in the lower portion and a hinge tab extending from the top portion that has a horizontal hinge pin channel;

a pair of connecting arms, each one of the pair of connecting arms including a hinge end configured to mate with the hinge tab of the vertical arms and to be hingeably connected to the hinge tab by a hinge pin, and a mounting end having an adjustment slot;

wherein the vertical slot in each vertical arm is configured to receive a vertical adjustment screw member therethrough that couples with a corresponding one of the nuts captured in the pair of horizontal slots to hold the vertical arm at a selected height relative to the pair of horizontal slots; and wherein the adjustment slot in each connecting arm is configured to receive a mounting screw therethrough, wherein the mounting screw is configured to mount a headrest plate onto the top of a barber chair.

9. The barber chair tray of claim 8, further comprising:

at the top portion of each of the pair of vertical arms, at least one angle-limiting extension that is configured to limit rotation of a one of the connecting arms hingeably connected to the vertical arm to a selected angle.

10. The barber chair tray of claim 9, wherein the selected angle is ninety degrees.

11. The barber chair tray of claim 8, wherein the plurality of tray features comprises at least one pocket that extends downward from the top of the tray body and which has a bottom.

12. The barber chair tray of claim 8, wherein the plurality of tray features comprises a clipper guard rack.

13. The barber chair tray of claim 8, further comprising:

a pocket that extends downward from the top of the tray body and which has a bottom; and a dispensing slot formed through the skirt to the pocket at a location on the skirt opposite the chair-facing side of the skirt; and a tray insert that is sized to cover the pocket, and which has a rim that extends outward from a periphery of a top of the tray insert that is configured to bear against the top of the tray to hold the tray insert over the pocket without allowing it to fall into the pocket.

* * * * *